US011133023B1

(12) United States Patent
Hedgecock

(10) Patent No.: US 11,133,023 B1
(45) Date of Patent: Sep. 28, 2021

(54) ROBUST DETECTION OF IMPULSIVE ACOUSTIC EVENT ONSETS IN AN AUDIO STREAM

(71) Applicant: V5 Systems, Inc., Fremont, CA (US)

(72) Inventor: Will Hedgecock, Nashville, TN (US)

(73) Assignee: V5 SYSTEMS, INC., Fremont, CA (US)

( * ) Notice: Subject to any disclaimer, the term of this patent is extended or adjusted under 35 U.S.C. 154(b) by 0 days.

(21) Appl. No.: 17/197,539

(22) Filed: Mar. 10, 2021

(51) Int. Cl.
*G10L 25/51* (2013.01)
*G10L 25/18* (2013.01)
*G10L 25/45* (2013.01)

(52) U.S. Cl.
CPC ..... *G10L 25/51* (2013.01); *G10L 25/18* (2013.01); *G10L 25/45* (2013.01)

(58) Field of Classification Search
CPC ..... G10L 25/51; G10L 25/18
See application file for complete search history.

(56) References Cited

U.S. PATENT DOCUMENTS 5,917,775 A 6/1999 Salisbury
7,558,156 B2 7/2009 Vook
10,540,883 B1 1/2020 Keil
10,969,506 B1 4/2021 Noll
2004/0100868 A1 5/2004 Patterson
2007/0159924 A1 7/2007 Vook
2010/0188929 A1* 7/2010 Kitaura ..... G10L 15/26 367/13
2012/0170412 A1* 7/2012 Calhoun ..... G01S 3/8083 367/118
2014/0095156 A1* 4/2014 Wolff ..... G10L 19/025 704/226
2015/0177363 A1 6/2015 Hermann
2015/0180986 A1 6/2015 Bisdikian
2016/0133107 A1* 5/2016 Showen ..... G08B 13/1672 340/540
2016/0232774 A1 8/2016 Noland
2017/0154638 A1 6/2017 Hwang
2017/0169686 A1 6/2017 Skorpik
2018/0046864 A1 2/2018 Flint
2018/0102136 A1* 4/2018 Ebenezer ..... G10L 25/78
2018/0301157 A1* 10/2018 Gunawan ..... G10L 21/0208
2019/0162812 A1 5/2019 Sloan
2019/0180606 A1 6/2019 Pirkle
(Continued)

OTHER PUBLICATIONS

Hiyane, K., & Iio, J. (2001). Non-speech sound recognition with microphone array. In International Workshop on Hands-free Speech Communication.*

(Continued)

*Primary Examiner* — Bryan S Blankenagel
(74) *Attorney, Agent, or Firm* — Hickman Becker Bingham Ledesma LLP

(57) ABSTRACT

This disclosure sets forth a system for detecting and determining the onset times of one or more impulsive acoustic events across multiple channels of audio. Audio is segmented into chunks of predefined length and then processed for detecting acoustic onsets, including cross-validating and refining the estimated acoustic onsets to the level of an audio sample. The output of the system is a list of channel-specific timestamped indices corresponding to the audio samples of the onsets of each impulsive acoustic event in the current segment of audio.

18 Claims, 6 Drawing Sheets

(56) References Cited

U.S. PATENT DOCUMENTS

| | | | | |
|---|---|---|---|---|
| 2019/0347920 | A1 | 11/2019 | Anderson | |
| 2020/0020215 | A1 | 1/2020 | Pirkle | |
| 2020/0278239 | A1 | 9/2020 | Ax | |
| 2020/0381006 | A1 | 12/2020 | Davis | |
| 2020/0402378 | A1* | 12/2020 | Connell, II ..... | H04W 56/0015 |

OTHER PUBLICATIONS

Hedgecock, U.S. Appl. No. 17/202,305, dated Mar. 15, 2021, Notice of Allowance May 24, 2021.

* cited by examiner

ROBUST DETECTION OF IMPULSIVE ACOUSTIC EVENT ONSETS IN AN AUDIO STREAM

FIELD OF THE INVENTION

The present disclosure relates to the general field of acoustic wave systems and devices, and more specifically to the field of impulsive acoustic event onset detection, specifically for subsequent use in determining the time of arrival of an event within a continuous stream of single- or multi-channel audio.

BACKGROUND

Acoustic onset detection in the context of speech, musical compositions, and beat recognition is a well-researched topic; however, the application of onset detection methodologies to the realm of impulsive environmental noise and event detection remains relatively unexplored. An impulsive event is defined empirically as any perceptible event with a sudden, rapid onset and fast decay, such as a gunshot, drum hit, jackhammer, balloon pop, clap, or similar type of sound.

Due to the recent proliferation and breakthroughs in Artificial Intelligence (AI), a field called Environmental Sound Recognition (ESR) has newly been established with the goal of exploring the nature of commonly occurring ambient sounds and devising methods to autonomously recognize and classify them. While sound classification has experienced a notable increase in interest in recent years, robust detection of the time-based onset of each acoustic event is still an unresolved issue. This is due, in part, to the difficulty in processing the typically noisy audio signals found in urban and suburban areas which oftentimes contain erroneous signals due to echoes, reverberations, overlapping noises, multipath, and dispersive line-of-sight obstacles.

The lack of existing methodologies to overcome these practical problems creates a hindrance in performing high-level analyses on environmental noises, including determining the inter-channel audio delays for a single event, computing the direction and angle-of-arrival of the source of an event of interest, or properly segmenting an audio clip to pass to an AI-based classifier for event recognition. It would be helpful to be able to robustly identify and quantify the onsets of acoustic events for use in secondary acoustic processes.

DETAILED DESCRIPTION

Figure 1:
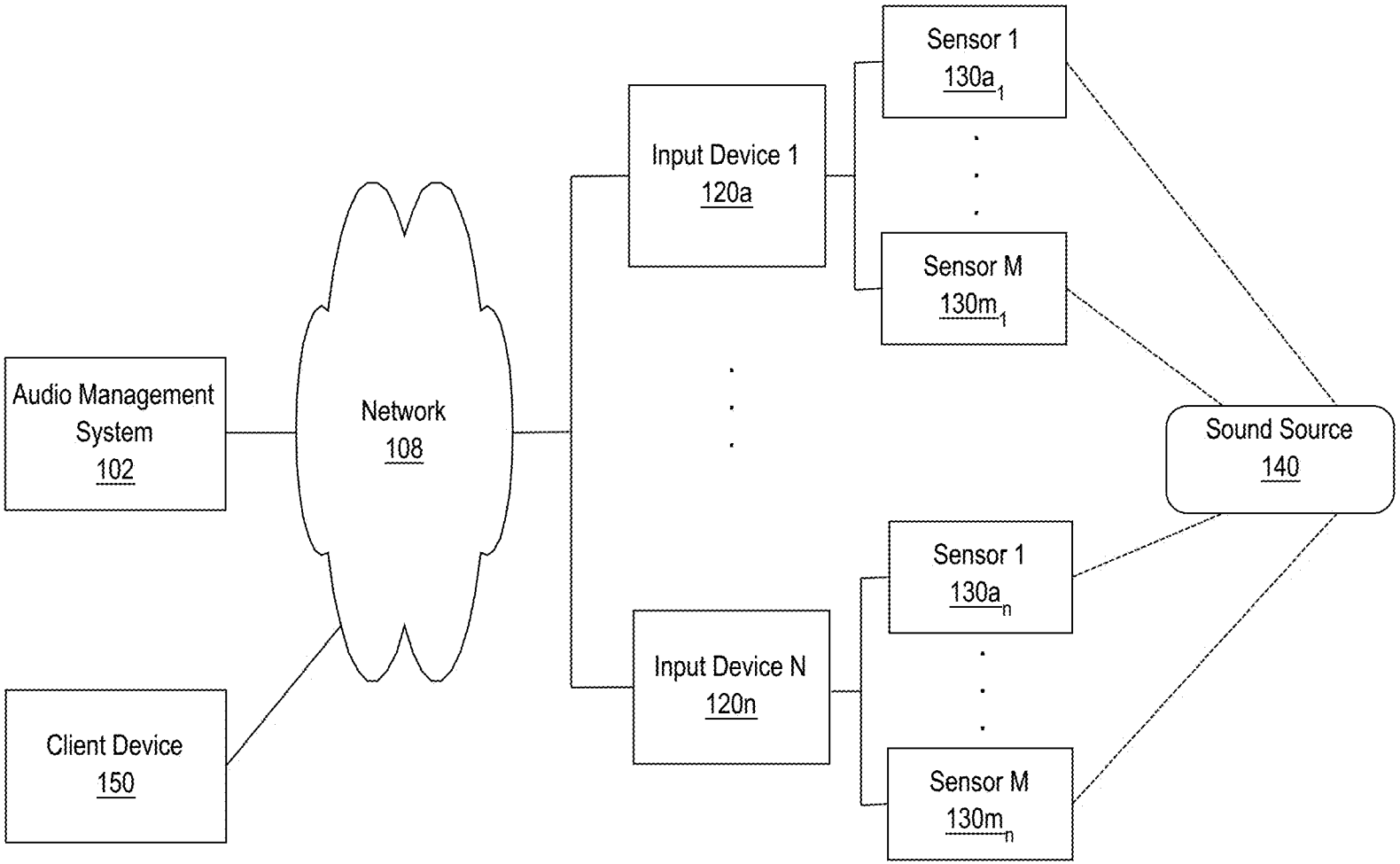
FIG. 1 illustrates an example computing environment with which various embodiments may be practiced.

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

1. General Overview

This application discloses an audio management system and related methods that address the issue of robustly and accurately detecting and locating the onset of an impulsive acoustic event within a stream of audio. Such accuracy and robustness are important to systems with functionality related to 1) timestamping acoustic events of interest, 2) computing inter-channel delays between audio streams originating from different microphones on a physical device, 3) determining the incoming direction or angle-of-arrival of a sound wave related to an acoustic event, or 4) segmenting portions of audio for further processing by event recognition or classification algorithms.

In some embodiments, an audio management system regularly segments a continuous stream of multi-channel audio into chunks of well-defined duration and operates through a series of ordered methods to iteratively narrow down and refine potential impulsive acoustic event onsets until only a list of valid events remain, comprising the timestamped onsets of each acoustic event of interest in the given audio segment for every available channel.

The audio management system is both computationally efficient and robust to environmental noise due to its multi-stage approach of pruning incorrect or improbable event onsets, followed by refinement of each resulting onset to achieve sample-level accuracy. In some embodiments, the audio management system operates based on a five-step methodology, as follows:

1. Intelligent event detection is carried out independently on all available audio channels for a single segment of audio. Statistical properties are computed for pre-defined windows of audio, and spectral analysis, statistical thresholding on acoustic property values, and acoustic property comparisons are used to identify a list of potential impulsive acoustic events on each available audio channel.
2. Consistent event detection is used to combine the independent intelligent detection results from each audio channel while verifying them for cross-channel consistency and pruning impossible or improbable events from the list. This step is also used to remove events from high-energy, noisy signals like wind which do not exhibit a high degree of cross-channel consistency for a single event.
3. Coarse-grained onset determination is carried out to generate a coarse estimate of the true acoustic onset in terms of indices of audio samples for each potential impulsive event in a segment of audio. This uses the information available on all audio channels, coupled with spectral analysis and amplitude thresholding, to determine the most likely region in which the onset is likely to have occurred.

4. Fine-grained onset determination is carried out to obtain a higher-resolution estimate of the true sample-level onset for each detected acoustic event. This step looks at each audio channel independently of the others to find a narrow region containing the actual acoustic event onset and combines these results to produce a fine-grained estimate of the real cross-channel event onset.
5. Channel delay estimation is carried out to correlate all audio channels such that sample-level onset values can be identified for each available channel of audio. This step also involves verifying the geometric validity of the multi-channel audio onsets, and impossible channel delays given known microphone geometries are excluded from the final list of results.

Using the above methodology, the audio management system is able to operate on a continuous stream of audio to provide real-time acoustic onset details without sacrificing the accuracy or robustness that often requires excessive computational or memory overhead. Additionally, the audio management system provides appropriate configurability such that onsets can be detected and refined whether they stem from relatively infrequent environmental causes, such as thunder, clapping, or human screams, or from extremely rapid impulsive events such as automatic gunfire or jack-hammering.

2. Example Computing Environments

FIG. 1 illustrates an example networked computer system in which various embodiments may be practiced. FIG. 1 is shown in simplified, schematic format for purposes of illustrating a clear example and other embodiments may include more, fewer, or different elements.

In some embodiments, the networked computer system comprises an audio management system 102, a client device 150, one or more input devices 120*a*-120*n*, which are communicatively coupled directly or indirectly via one or more communication networks 108. Each of the input devices 120*a*-120*n* is coupled to one or more sensors. For example, 120*a* is coupled to 130$a_1$-130$m_1$, and 120*n* is coupled to 130$a_n$-130$m_n$. The sensors detect sounds from the sound source 140 and generate audio data.

In some embodiments, the audio management system 102 broadly represents one or more computers, virtual computing instances, and/or instances of a server-based application that is programmed or configured with data structures and/or database records that are arranged to host or execute functions including but not limited to detecting potential impulsive acoustic events from incoming audio streams and determining onset times of impulsive acoustic events. The audio management system 102 can comprise a server farm, a cloud computing platform, a parallel computer, or any other computing facility with sufficient computing power in data processing, data storage, and network communication for the above-described functions.

In some embodiments, each of the input devices 120*a*-120*n* is coupled to one or more sensors, such as 130$a_1$-130$m_1$. The sensors can be microphones to detect sounds and generate audio data. Each of the input devices 120*a*-120*n* has a size roughly no larger than the size of a desktop computer. The coupling is typically through internal embedding, direct integration, or external plugins. Therefore, the one or more sensors coupled to an input device are located relatively close to one another.

In some embodiments, the sound source 140 could be any source that produces audio, such as a gun, a human, the nature, and so on.

In some embodiments, the client device 150 is programmed to communicate with the audio management device 102. The client device 150 is typically a desktop computer, laptop computer, tablet computer, smartphone, or wearable device.

The network 108 may be implemented by any medium or mechanism that provides for the exchange of data between the various elements of FIG. 1. Examples of network 108 include, without limitation, one or more of a cellular network, communicatively coupled with a data connection to the computing devices over a cellular antenna, a near-field communication (NFC) network, a Local Area Network (LAN), a Wide Area Network (WAN), the Internet, a terrestrial or satellite link, etc.

In some embodiments, when an impulsive acoustic event occurs, such as a gunshot, at the sound source 140, each of the sensors 130$a_1$-130$m_1$ through 130$a_n$-130$m_n$, to which the sound of gunshot could travel would capture the sound, generate corresponding audio data, and transmit the audio data to the audio management system 102 directly or through the input devices 120*a*-120*n*. The audio management system 102 processes the audio data generated by the sensors 130$a_1$-130$m_1$ coupled to the input device 120*a*, for example, to detect the onset of the impulsive acoustic event, namely the beginning of the impulsive event or when the gunshot occurs. The audio management system 102 could then send the onset information to the client device 150, which could be associated with law enforcement or first responders, for example.

3. Example Computer Components

Figure 2:
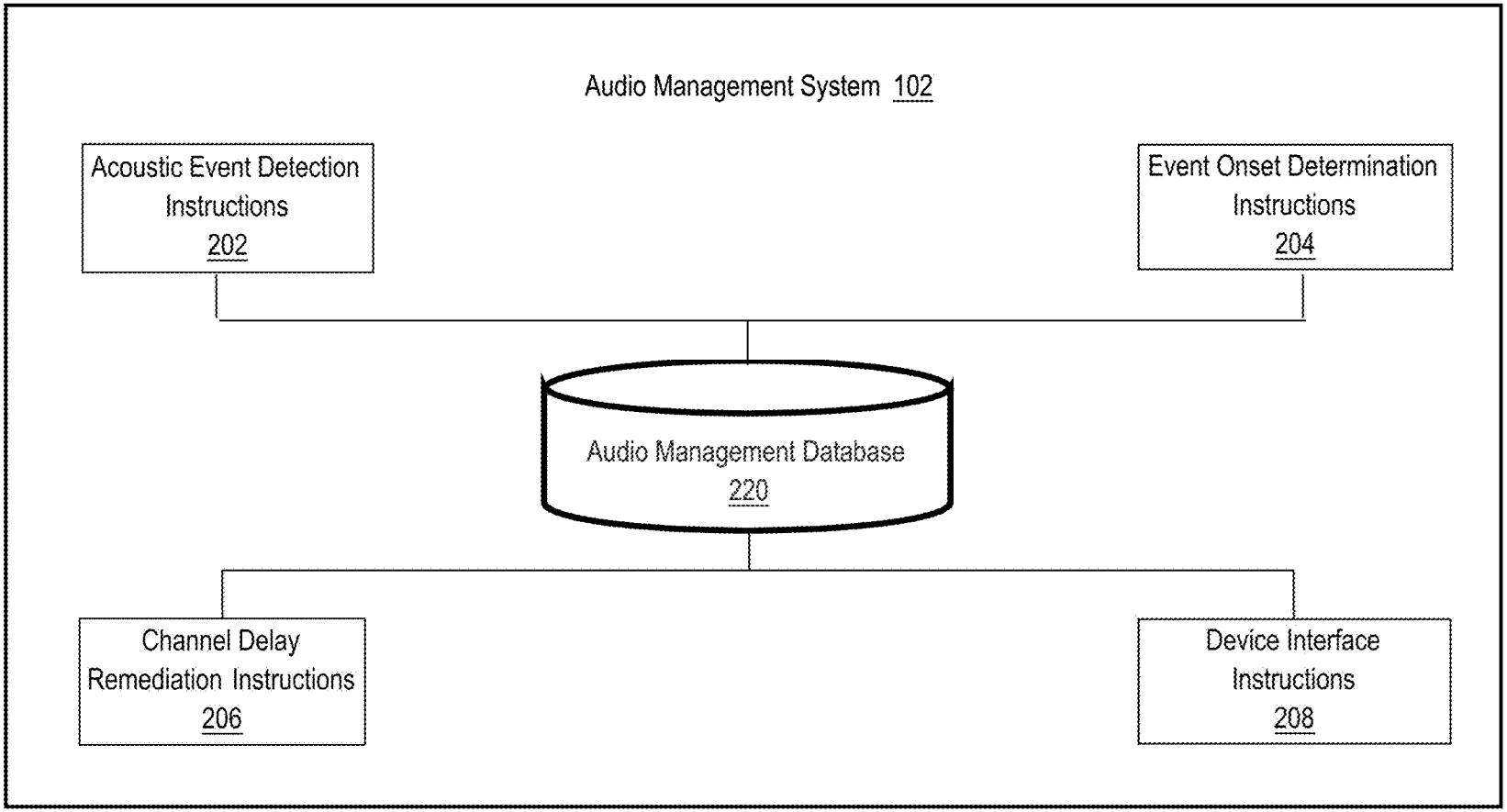
FIG. 2 illustrates example computer components of an audio management system.

FIG. 2 is shown in simplified, schematic format for purposes of illustrating a clear example and other embodiments may include more, fewer, or different elements connected in various manners. Each of the functional components can be implemented as software components, general or specific-purpose hardware components, firmware components, or any combination thereof. A storage component can be implemented using any of relational databases, object databases, flat file systems, or JSON stores. A storage component can be connected to the functional components locally or through the networks using programmatic calls, remote procedure call (RPC) facilities or a messaging bus. A component may or may not be self-contained. Depending upon implementation-specific or other considerations, the components may be centralized or distributed functionally or physically.

FIG. 2 illustrates example computer components of an audio management system. In some embodiments, the audio management system 102 comprises acoustic event detection instructions 202, event onset determination instructions 204, channel delay remediation instructions 206, and device interface instructions 208. The main controller 102 also comprises an audio management database 220.

In some embodiments, the acoustic event detection instructions 202 enable detection of acoustic events of interest from incoming audio signals. The detection includes identifying a list of acoustic events that include acoustic peaks but not certain features inconsistent with impulsive acoustic events, and that occur at reasonable times.

In some embodiments, the event onset determination instructions 204 enable determination of onsets (times of sound generation, such as the time a gunshot is fired) of the identified acoustic events of interest. Coarse-grained determination is first performed by merging similar acoustic events and extracting broad regions that are likely to include onsets from the merged acoustic events. Fine-grained determination is then performed by narrowing down the broad regions based on features characterizing when onsets are expected to occur within the broad regions.

In some embodiments, the channel delay remediation instructions 206 enable further adjustment of determined onsets. The adjustment includes calibrating the determined onsets based on data from different microphones by taking into account channel delays.

In some embodiments, the device interface instructions 208 enable interaction with other devices, such as receiving an input audio signal from input devices 120*a*-120*n* or outputting results of analyzing the input audio signal, such as the estimated onsets of impulsive acoustic events, to the client device 150.

In some embodiments, the audio management database 220 is programmed or configured to manage relevant data structures and store relevant data for functions performed by the audio management system 102. The data may be related to audio signals in terms of sound waveforms, transformed audio signals in the frequency domains, audio segments, frequency bins, input devices and associated microphones, common or background sounds, sounds associated with impulsive acoustic events, thresholds on acoustic properties, analytical data derived from input data and existing data, and so on.

4. Functional Descriptions

In some embodiments, the audio management system is designed to be agnostic to the modality of the incoming audio signal, its length, and its number of constituent audio channels. As such, the input to the audio management system can take the form of any valid audio data, with the expectation that it is represented in a floating-point pulse-code modulation (PCM) format at a user-configurable sampling rate, such as 48 kHz. In order to ensure that all inputs to the detection methodology are uniform in terms of length, sampling rate, number of samples or other aspects to reduce the number of unknown variables in the system, the first step performed by the audio management system is to segment the incoming audio into one-second chunks containing audio samples from all available channels which are then processed through the onset detection methods as set forth in the remainder of this description. Within a one-second chunk, the audio sample at each time point from each channel can be given a unique index. The audio management system is designed to operate in real time on either prerecorded or live streaming audio with no additional changes to the methodology itself.

1. Intelligent Event Detection

In some embodiments, a one-second audio segment having a waveform is first passed to this method for detecting the presence of one or more impulsive acoustic events within the segment. The first step of this method is to remove any direct current (DC) bias from the audio signal by passing the raw audio of each available channel through a DC blocking filter known to someone skilled in the art, with the equation: $\hat{a}[t]=a[t]-a[t-1]+(R*\hat{a}[t-1])$, where a[t] is the audio sample at time t, $\hat{a}[t]$ is the bias-removed audio sample at time t, and R is a filter pole which weights how heavily the previous audio sample influences the current audio sample, commonly set to 0.995.

In some embodiments, a time-condensed envelope of the resulting debiased audio is then extracted by concatenating the maximum magnitudes (regardless of sign) within a fixed-size sliding window of empirically configurable length, $t_w$ (e.g., 10 milliseconds, to ensure that separate peaks in the debiased audio are not merged in the envelope while still resulting in a smooth envelope). The window is shifted forward by a stride length, $t_s$ each time, commonly assumed to be one-half the window size $$t_s = \frac{t_w}{2},$$

which creates a 50% overlap in the calculation of each envelope value. Peaks within this acoustic envelope, which are also peaks in the debiased audio, are then detected by searching for samples which are:

1) greater than the previous envelope sample, 2) a time delay of at least $t_d$ milliseconds from a previously identified peak, where $t_d$ can be chosen based on the minimum amount of time expected between two successive impulsive acoustic events, such as 40 milliseconds, and 3) above an adaptive threshold value specified by the formula:

$$p_{thresh} = \frac{(x_{max} + x_{avg})}{2} + (\alpha_i * d),$$

where $x_{max}$ is the maximum envelope amplitude within the current second of audio, $x_{avg}$ is the average envelope amplitude, $\alpha_i$ is a configurable influence factor, and d is the sum of the absolute deviations from $x_{avg}$ of all envelope samples. This formula specifies a threshold value halfway between the average and maximum values within the current second of audio, which can be thought of as the sample magnitude halfway between the background noise and maximum foreground audio level in the current segment. Additionally, the deviation value, d, multiplied by an influence factor can be used to adjust the threshold up or down based on the variance of the signal, or alternately, the influence factor may be set to 0 to disable any noise variance from affecting the threshold at all.

Each identified peak represents a potential acoustic event in terms of the index of the corresponding sample. Such a local maximum amplitude may not necessarily be found at the beginning of the portion of the waveform caused by an acoustic event, due to the fact that acoustic dispersion, diffusion abnormalities, reverberations, and non-line-of-sight effects occur, but these amplitude peaks can nonetheless be used to find the true onset of the acoustic event, as discussed below. The concatenation of all peaks across all channels which satisfy the above criteria will form the initial list of potential impulsive events in the current segment of audio.

In some embodiments, a spectrogram, s, is then computed by passing the debiased audio through a Fourier Transform, such as a Short-Time Fourier Transform (STFT), with the same window size and overlap used in constructing its time-condensed envelope, producing a frequency-domain image of the audio segment containing the same number of time steps present in the previously calculated acoustic envelope. This spectrogram, s, is further used to create an estimate of the noise spectrum, W, of the audio signal by determining which $p_n$ percent of available time steps, such as 50%, out of all available time steps in the current segment of audio, contain the least amount of spectral power and averaging the spectral power present in each frequency bin over those time steps. The nature of transient events makes it likely that the audio samples containing the lowest $p_n$ percent of the spectral power in any given window will correspond primarily to noise. The spectral power used to identify these timestamps can be replaced by the spectral magnitude, power, energy, or other attribute of the spectral signal. The resulting noise spectrum, W, is used to create a denoised audio spectrogram, s, by over-subtracting the noise spectrum from the spectrogram, s, for each frequency bin, b, at each time step, t, using an over-subtraction parameter, α: $\hat{s}[t, b]=s[t, b]-(\alpha * W[b])$. The over-subtraction parameter is used to increase the signal-to-noise ratio and can be set to 5, for example.

In some embodiments, the resulting denoised audio spectrogram is used to pare down the list of potential acoustic events previously computed from the acoustic envelope. An impulsive acoustic event of interest will most typically be defined as a sound with a sudden high amplitude in relation to the environmental noise floor, a fast rate of decay, and a short duration on the order of milliseconds. In the frequency domain, it may be characterized by the temporally sudden appearance of high-energy spectral content, where the change in spectral magnitude is apparent at both low and high frequencies, and the spectral energy is relatively uniform or only gradually decreasing with increasing frequencies above the frequencies found in the ambient environmental background noise. These characteristics are used to trim the list of potential acoustic events of interest by carrying out the following steps for each time step, t, present in the spectrogram:

1. Calculate the cumulative spectral magnitude of the current periodogram, $\hat{s}[t]$, by accumulating over all frequency bins into one value.
2. Calculate a high-frequency content (HFC) value by accumulating each denoised frequency bin multiplied by its own bin number, such that higher-frequency values are weighted more heavily, as follows:

$$HFC[t] = \sum_{b=0}^{bins} (b * \hat{s}[t, b]).$$

3. Compute the ΔHFC[t] value by subtracting the HFC value at the previous time step from the HFC value at the current time step.
4. Calculate a spectral flux value at the current time, t, for each bin, b, by subtracting the previous periodogram, $\hat{s}[t-1]$, from the current periodogram $\hat{s}[t]$:

$$\text{Flux}[t,b]=\hat{s}[t,b]-\hat{s}[t-1,b].$$

5. When the cumulative spectral flux value over all bins, $$\sum_{b=0}^{bins} Flux[t, b],$$

or the ΔHFC value is less than or equal to 0, remove any events from the list of potential events of interest corresponding to the current time step (i.e., having a peak sample index of t). Specifically, when the spectral flux is less than 0, the acoustic sound is becoming quieter at that timestamp instead of louder; similarly, when the ΔHFC value is less than 0, the higher frequencies are becoming softer and can therefore be ignored. These features would not typically characterize an impulsive acoustic event.

6. Compute a reference band energy, $e_{ref}$, for the current time step by accumulating the periodogram bin values between the frequencies of 1 and an empirically configurable upper limit, $f_{ref,upper}$, which denotes the highest frequency that is likely to be encountered when only background noise is present in a given environment, such as 200 Hz.
7. Determine if the cumulative spectral energy between a configurable minimum frequency, $f_{test1,min}$, and the highest possible frequency given the sampling rate of the current audio segment, is over x times greater than the reference band energy, $e_{ref}$, where $f_{test1,min}$ denotes the minimum frequency such that common everyday sounds, such as speech, singing, car engines, airplanes, clapping, etc., are unlikely to produce a higher cumulative energy in frequencies greater than $f_{test1,min}$ than in frequencies below $f_{test1,min}$, and x is chosen empirically based on the typical noise frequency characteristics present in the environment in which a set of sensors is deployed. A reasonable value for $f_{test1,min}$ is 2000 Hz and for x is 3. A positive determination result suggests an event that has a high spectral magnitude but primarily high frequency content (such as a nearby bird chirp or an electronic beep), in which case, any potential events corresponding to the current time step should be excluded. Specifically, the relative lack of changes in low-frequency components compared to high-frequency components would not typically characterize an impulsive acoustic event.
8. Compute a magnitude threshold, $e_{thresh}$, as $p_b$ percent of the spectral magnitude of the frequency bin which contains the largest spectral magnitude for the current time step, to determine whether other frequency bins contain appreciable spectral content in relation to the bin with the largest magnitude. The lowest frequency bin with appreciable spectral content, namely the lowest frequency bin where the total spectral magnitude equals or exceeds $e_{thresh}$, is identified. The chosen threshold percentage, $p_b$, should be quite low, on the order of 10%, to ensure that a frequency bin is not ignored if it contains even a small amount of energy attributable to the foreground signal.
9. Exclude potential events for which the lowest frequency bin with appreciable spectral content, as calculated in the step above, is greater than some threshold frequency, $f_{test2}$, such as around 1000 Hz, which denotes the minimum frequency value below which an acoustic event may contain no spectral content and still be considered an event of interest. This is used to exclude events with no appreciable low-frequency spectral content, as the lack of low-frequency components would not typically characterize an impulsive acoustic event.
10. When the cumulative spectral magnitude of the current time step, t, is less than some small percentage, for example 1%, of the maximum possible magnitude, remove any potential events corresponding to the current time step. This ensures that only readily perceptible acoustic events are examined.

11. Finally, when there is any single frequency band of configurable size, $f_b$, which contains greater than $x_{lim}$ times the amount of spectral energy calculated in the lowest frequency band, from 1–$f_b$ Hz, remove any potential events corresponding to the current time step, t. The choice of values for $f_b$ and $x_{lim}$ is empirical and may change based on the specific hardware and software configurations used to record the audio, as well as on the types of impulsive events to include in the detection list; however, reasonable values for these parameters may be 4 kHz and 3, respectively. This step is used to exclude events which contain unusually strong amounts of narrowband frequency content, as such events are rarely, if ever, found in nature outside of musical contexts, birdsong, or electronic noise.

Figure 3A:
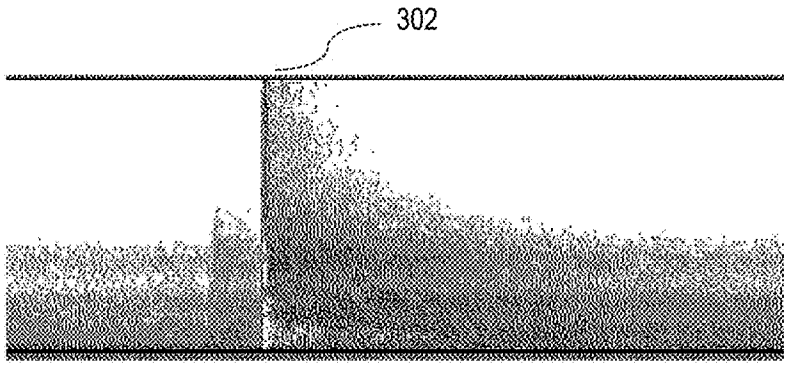
FIG. 3A illustrates an example spectrogram for a channel of audio of a high-amplitude, line-of-sight gunshot.
Figure 3B:
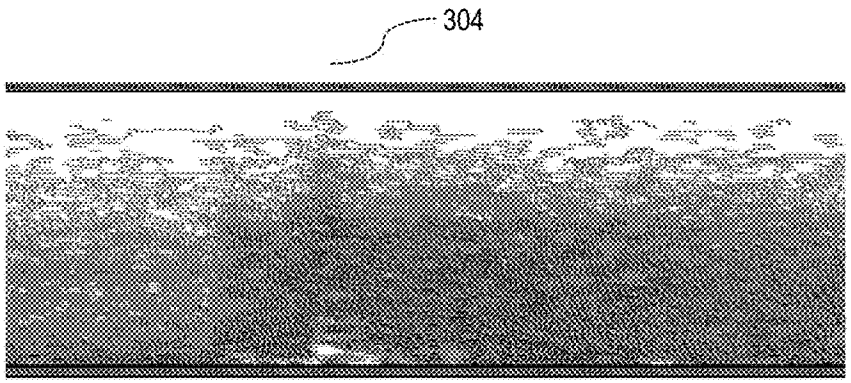
FIG. 3B illustrates an example spectrogram for a channel of audio of a distant, non-line-of-sight gunshot with non-negligible background noise.
Figure 3C:
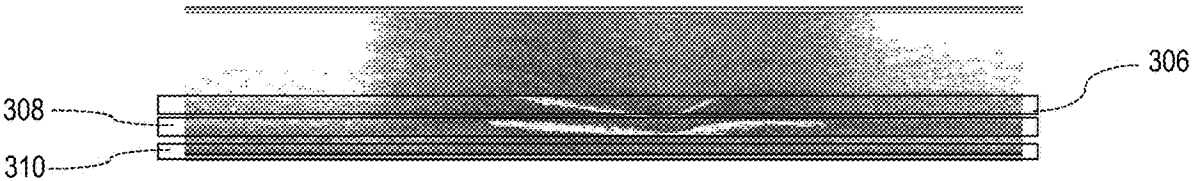
FIG. 3C illustrates an example spectrogram for a channel of audio of a bird chirping.

FIG. 3A illustrates an example spectrogram for a channel of audio of a high-amplitude, line-of-sight gunshot. FIG. 3B illustrates an example spectrogram for a channel of audio of a distant, non-line-of-sight gunshot with non-negligible background noise. FIG. 3C illustrates an example spectrogram for a channel of audio of a bird chirping. FIG. 3A shows a clear onset around the peak 302 and thus can easily be identified as illustrating an impulsive acoustic event. While these spectrograms look distinct, it may not be immediately clear why FIG. 3B illustrates an acoustic event of interest in the form of a gunshot while FIG. 3C does not illustrate an impulsive acoustic event. The steps outlined above achieve the detection specificity by systematically examining a multitude of spectral characteristics that define an impulsive event of interest. For example, the bird chirp illustrated in FIG. 3C may be excluded by Step 11, in which a single higher frequency band, 306 or 308, contains substantially more spectral energy than the lowest frequency band 310. Likewise, the non-obvious acoustic peak 304 due to a non-line-of-sight gunshot illustrated in FIG. 3B can be detected due to its positive spectral flux and ΔHFC content, having no single high-frequency bands of high-energy content, no cumulative high-frequency content changes without a corresponding change in low-frequency content, and other properties that pass all detection steps outlined above.

In some embodiments, not all of the steps described above are performed, or one or more steps are performed in a different order than described above. For example, some of the steps to exclude potential acoustic events may be performed only if the criteria for selecting those acoustic events characterize the acoustic events of interest. In addition, non-causal steps do not need to be performed in the sequence indicated above. Also, any of the steps above may add to or amend data relevant to a specific acoustic event. If, for example, a set of statistical properties is calculated at time step, t, for which an acoustic event exists in the list of potential acoustic events, as indicated by having an envelope peak at the same time step, t, those statistical properties may be retained in association of the acoustic event for future reference. After completion of the above steps for every time step in the spectrogram, there will remain a list of events and related statistical properties corresponding to all potential impulsive acoustic events of interest in the current segment of audio.

In some embodiments, additional statistical processing may be carried out on each channel of debiased audio to further reduce the number of items in this list, including but not limited to calculating the zero crossing rate, low-energy sample rate, bandwidth, phase deviation, spectral centroid, spectral spread, spectral flatness, spectral crest, spectral energy, spectral entropy, spectral kurtosis, spectral skewness, spectral roll-off, total energy, average energy, peak energy, or spectral difference over distinct windows of the same size used to calculate the acoustic envelope and spectrogram. The time-based progression of these statistics can be compared to similar progressions for known acoustic events of interest to further exclude impulsive events about which the user is not interested.

2. Consistent Event Detection

In some embodiments, a second step in identifying potential events of interest is to determine which events are consistent among all available audio channels. In general, as the channels correspond to microphones that are located on the same physical device and thus are relatively close to one another, samples obtained from different channels in segments corresponding to the same time steps are treated as corresponding to the same event at this stage. An initial consistency check is completed by iterating through each potential event detected in the previous "Intelligent Event Detection" step and running the corresponding audio through a high-energy wind detection process to exclude events which appear to be statistically impulsive but are not due to a single specific external stimulus. One known wind detection methodology operates by calculating the position of the spectral centroid of the current event of interest, ensuring that it is lower than ~4 kHz, and also ensuring that the total spectral power at frequencies higher than 4 kHz is less than a user-configurable threshold value, such as 1. When wind is detected at any time step, t, for any single channel, all potential events with a peak envelope value located at that time step are removed from the list.

In some embodiments, a mapping is then created between each time step containing a potential event of interest and the number of channels on which that event was detected during "Intelligent Event Detection." The maximum number of channels on which any single event was detected is stored as the minimum threshold for consistent event detection, and all potential events which were detected on fewer than this threshold number of channels are removed from the event list. This is equivalent to only retaining potential events for which the number of channels on which the event was detected is equal to the maximum number of consistently detected channels for any event within the current segment of audio. Additionally, a record is maintained of the greatest cumulative spectral magnitude value over all frequency bins that is encountered on any channel for any given time step in the current segment of audio.

In some embodiments, after the greatest spectral magnitude value has been identified, all events that remain in the detection list are removed when they have a cumulative spectral magnitude value less than some threshold percentage, $p_{thresh}$, of this segment-wide maximum. The threshold percentage, $p_{thresh}$, can be 10%, for example. This increases temporal consistency across different channels by detecting a channel with a particularly low spectral magnitude, which normally occurs with echoes, reverberations, and other non-foreground noises due to dispersion, scattering, and decay. Those events that likely correspond to such non-foreground noises would thus not be included as potential events of interest when an actual event is present in the audio segment.

In some embodiments, at the end of this step, there remains a list of consistently detected acoustic events, along with all of the spectral and statistical information for each channel of audio on which the event was detected. This list is then passed to a subsequent method for determining the coarse-grained acoustic onset times for each identified event.

3. Coarse-Grained Onset Determination

In some embodiments, to determine a rough estimate of the location of the onset of each event in the list of consistently detected events, the list should be ordered from earliest to latest according to its constituent peak envelope sample indices. For each event, when there are at least $t_{d,min}$ milliseconds between the current event and the previously detected event, where $t_{d,min}$ can be chosen as the shortest expected time between two consecutive impulsive events, such as 40 milliseconds, that event is retained in the list of events of interest. The coarse-grained onset is then chosen as the earliest time step for which the cumulative spectral magnitude on any of its constituent audio channels is equal to the maximum cumulative spectral magnitude within the region of interest, spanning a duration of $t_{d,min}$ milliseconds and centered on the original peak sample index. Otherwise, all subsequent events with similar onset times (e.g., less than $t_{d,min}$ milliseconds apart from a retained event) are discarded. In such a way, the coarse-grained onset will represent the beginning of the portion of the acoustic signal which contains the majority of the foreground information for each detected event.

4. Fine-Grained Onset Determination

FIG. 4 illustrates an example process of performing fine-grained onset determination on an example waveform for a channel of audio. In some embodiments, each coarse-grained event onset in the list of detected events is used as the starting point in a search algorithm through the DC bias-removed raw acoustic audio for the fine-grained onset of the acoustic event. The algorithm iterates through all available audio channels for each acoustic event as follows.

Figure 4A:
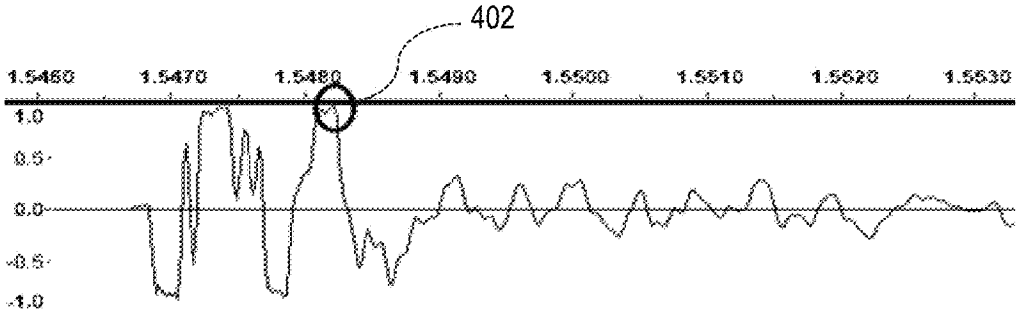
FIG. 4A illustrates determining the sample having the maximum amplitude value in a region on an example waveform representing a gunshot.
Figure 4B:
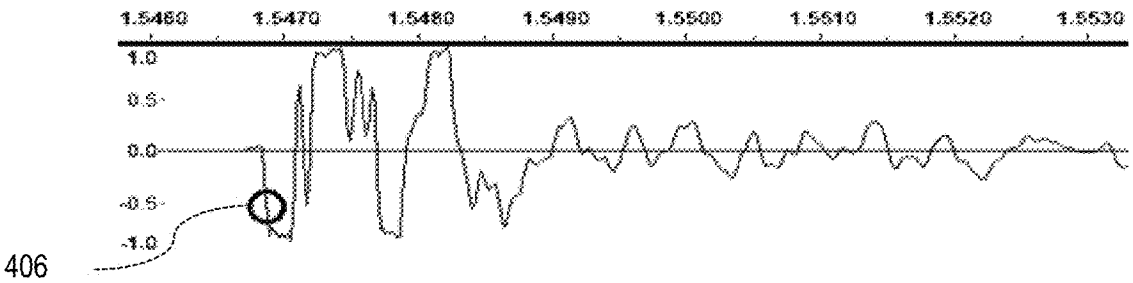
FIG. 4B illustrates identifying the first sample in the region which contains a certain percentage of the maximum amplitude value on the example waveform.
Figure 4C:
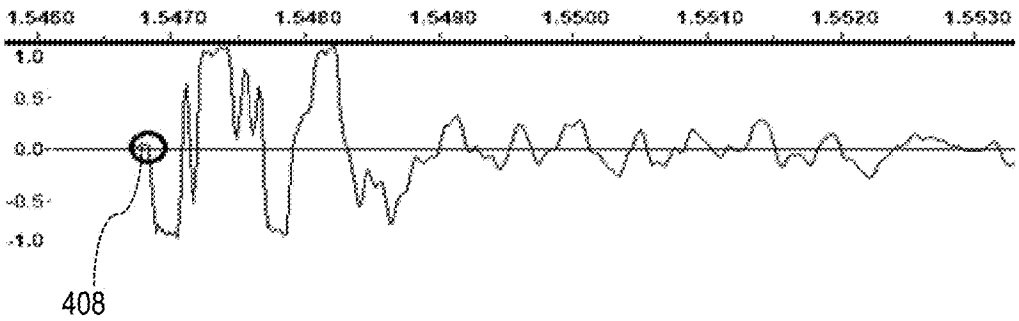
FIG. 4C illustrates locating the first zero-crossing on the example waveform.

1. Determine the maximum amplitude value of the raw acoustic audio within a region of $d_{search}$ milliseconds, centered on the location of the coarse-grained event onset, where $d_{search}$ should be chosen as the maximum length of time expected for an incoming acoustic wave to reach its maximum amplitude value from an initial amplitude of 0, empirically chosen as 20 milliseconds. This step is used to identify the most foreground, loudest audio sample corresponding to a given acoustic event. FIG. 4A illustrates determining the sample having the maximum amplitude value in a region on an example waveform representing a gunshot. The amplitude value, which is 1 in this case, of the sample 402 is the maximum in a 20-millisecond region centered on the identified coarse-grained event onset, which is very close to the sample 402 in this case.
2. Identify the first sample in the above region which contains at least $p_{amp}$ percent of this maximum amplitude value as the initial position at which to begin searching for the fine-grained event onset. The percentage $p_{amp}$ can be chosen empirically based on the average number of samples required for the audio wave to increase from 0 to its maximum amplitude for a given acoustic event. For extremely loud, sudden events, this may occur within one sinusoidal cycle, whereas for distant, non-line-of-sight events, this may occur more slowly. A good starting point for $p_{amp}$ is 50%, which 1) corresponds to the actual first cycle of the acoustic event in the case of high-amplitude foreground transients, and 2) corresponds to the point in the acoustic signal in which the acoustic event becomes the foreground signal in the case of quieter events in which the acoustic onset may have a lower amplitude than the environmental noise floor or in the case of non-line-of-sight events in which the onset is temporally elongated due to dispersion. FIG. 4B illustrates identifying the first sample in the region which contains a certain percentage of the maximum amplitude value on the example waveform. The sample 406 is the first one in the 20-millisecond region which cumulatively contains at least 50% of the maximum amplitude, which is 0.5 (shown as −0.5 in the waveform).
3. Locate the fine-grained event onset by searching backward from this location for the first zero-crossing in the raw audio signal. This onset is added to a running list of potential fine-grained onsets for the current acoustic event. FIG. 4C illustrates locating the first zero-crossing on the example waveform. The sample 408 is the first one that has an amplitude value of 0 starting backward from the sample 406.

After this process has been repeated for all available acoustic channels for a single course-grained event onset, the median onset is chosen to exclude outliers and erroneous onset estimates as the actual fine-grained event onset for all channels of the current event, and the process is repeated for the next detected event in the list.

5. Channel Delay Estimation

The term "channel delay" refers to the time difference of arrival of a single acoustic wave at multiple independent audio channels and is caused by the fact that it takes a finite amount of time for an acoustic wave to travel through space to arrive at each microphone. When examining a raw waveform, it will appear as though a nearly identical waveform is present on all channels with varying sample offsets. These offsets are the channel delays, and when combined with the spatial geometry of the microphones themselves, they can be used to determine the angle of arrival of an acoustic wave. In some embodiments, the sample-level channel delays for each available channel of a detected event are calculated using the following search algorithm:

For each possible pair of audio channels, {i,j}, in a given segment of audio, calculate the maximum number of channel delay samples possible, $d_{max,i,j}$, using the speed of sound and the geometric configuration of the microphones used to record the audio. This can be done by assuming that the incoming audio wave is arriving parallel to the axis connecting each pair of microphones and making the following calculation for each microphone pair:

$$d_{max,i,j} = \frac{f_s \times \sqrt{(x_j - x_i)^2 + (y_j - y_i)^2 + (z_j - z_i)^2}}{c_s}$$

where $c_s$ is the speed of sound, $f_s$ is the audio sampling rate, and (x, y, z) are the spatial coordinates of the microphones. $d_{max}$ is then set as the maximum value of $d_{max,i,j}$ over all possible values for i and j.

Extract a slice of DC bias-removed multi-channel audio, a, of length $N_w+(2*d_{max})$ samples, where the center point of the extracted audio is chosen as the fine-grained acoustic onset for the current event, $N_w$ is empirically chosen based on the expected number of audio samples over which an acoustic transient is coherent across channels, for example 160 samples, and the extracted audio length includes a $2*d_{max}$ term to account for the additional samples needed to shift each channel of audio up to $\pm d_{max}$ samples due to the current permutation of channel delays.

For every possible permutation, k, of channel delays across all channels (e.g., for $N_{ch}$ channels of audio, each containing $d_{max}$ possible channel delay values, there would be $(2 \cdot d_{max})^{N_{ch}}$ permutations—where $d_{max}$ is doubled to account for the fact that channel delays can be negative depending on the order in which the acoustic wave arrived at the microphones):

Ignore the current permutation of channel delays, k, when it is not physically possible given the combined geometry of the microphones. For instance, under the assumption that all microphone channels are located very near to one another on a single physical device and that the distance between each microphone pair is much less than the distance to the source of an incoming sound wave, then the incoming wave can be modeled as a plane orthogonal to the direction of motion of the wave. Under this assumption, if there are four microphone channels positioned such that the microphones do not also form a plane, then a permutation of [0, 0, 0, 0] would be physically impossible, because the incoming sound wave could not geometrically arrive at all four microphones at the same time.

Calculate a correlation coefficient, $r_k$, for the current permutation of channel delays, k, based on a similarity measure discussed in Kennedy, Hugh. (2007). A New Statistical Measure of Signal Similarity. Conference Proceedings of 2007 Information, Decision and Control, IDC. 112-117. 10.1109/IDC.2007.374535.

$$r_k = \frac{\sum_{n=1}^{N_w}\left(\sum_{ch=1}^{N_{ch}} a[ch][k[ch]+n]\right)^2}{\sum_{n=1}^{N_w}\sum_{ch=1}^{N_{ch}} (a[ch][k[ch]+n])^2 - \sum_{n=1}^{N_w}\left(\sum_{ch=1}^{N_{ch}} a[ch][k[ch]+n]\right)^2},$$

where a represents the multi-channel, DC bias-removed window of audio described above, k[ch] indicates the channel delay value for channel ch within the current permutation k, and k[ch]+n refers to the delayed sample of audio for the current permutation. This coefficient measures the similarity between all channels of audio when each channel is delayed by the current permutation of channel delays. As the set of channel delays causes the waveforms in each individual audio channel to align more coherently, this coefficient value increases.

Keep track of the channel delay permutation which results in the highest correlation coefficient.

In some embodiments, the permutation of channel delays with the best correlation coefficient value is taken as the correct set of channel delays. These delays are then added to the fine-grained event onset for the current event to determine the sample-level event onsets for each acoustic channel. This process is repeated for all detected events in the current segment of audio. In other embodiments, other machined learning techniques can be used to identify the delays of respective channels that prevent the time series from the respective channels being aligned, such as multivariate autoregressive models or generalized magnitude squared coherence (GMSC).

5. Example Processes

Figure 5:
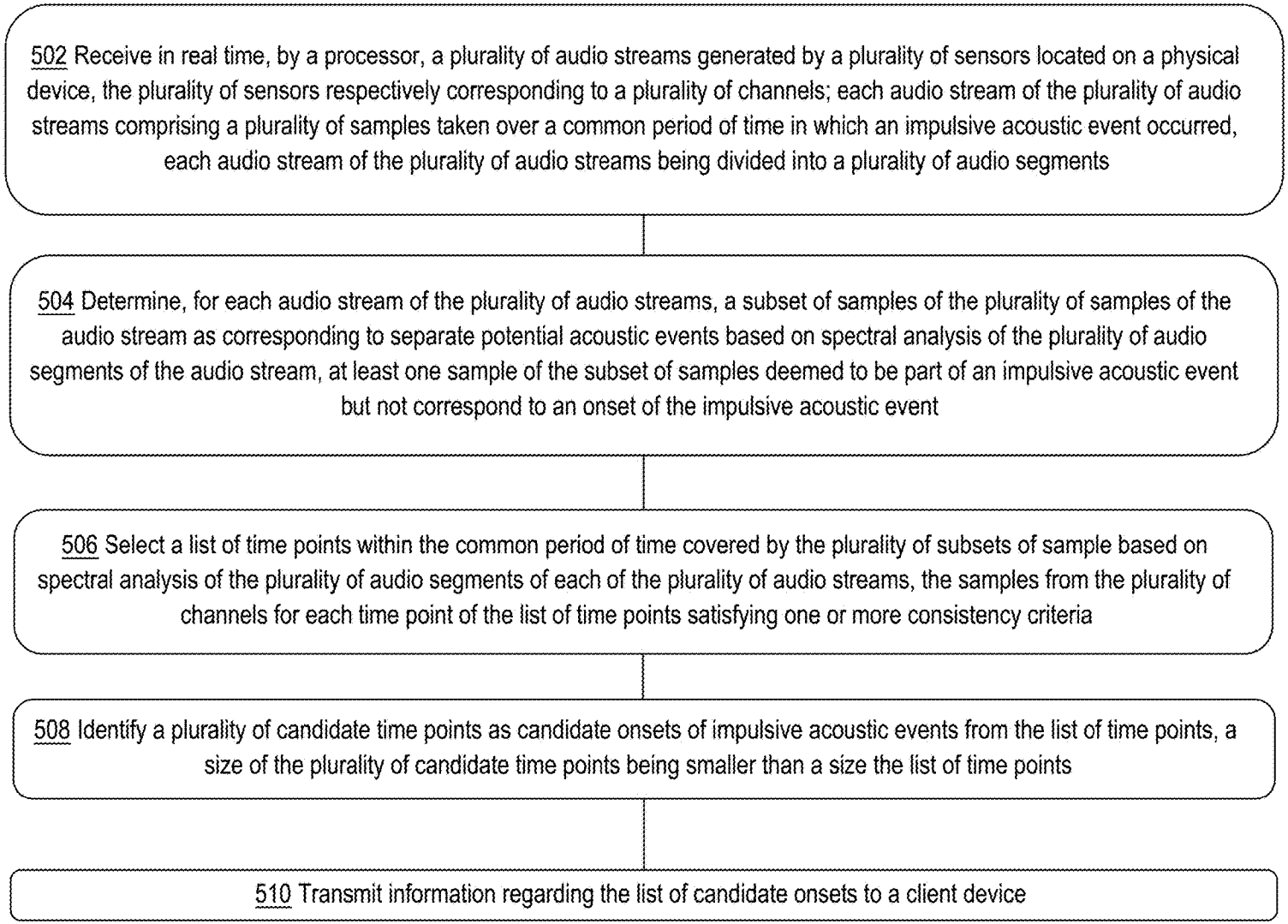
FIG. 5 illustrates an example process performed by the audio management system.

FIG. 5 illustrates an example process performed by the audio management system. FIG. 5 is intended to disclose an algorithm, plan or outline that can be used to implement one or more computer programs or other software elements which, when executed, cause performing the functional improvements and technical advances that are described herein. Furthermore, the flow diagrams herein are described at the same level of detail that persons of ordinary skill in the art ordinarily use to communicate with one another about algorithms, plans, or specifications forming a basis of software programs that they plan to code or implement using their accumulated skill and knowledge.

In step 502, the audio management system is programmed to receive, in real time, a plurality of audio streams generated by a plurality of sensors located on a physical device. The plurality of sensors respectively corresponds to a plurality of channels. Each audio stream of the plurality of audio streams comprises a plurality of samples taken over a common period of time in which an impulsive acoustic event occurred. Each audio stream of the plurality of audio streams is divided into a plurality of audio segments.

In some embodiments, each of the plurality of audio streams can be sampled at 48 kHz. Each of the plurality of audio segments can be one second long.

In some embodiments, the impulsive acoustic event can be defined empirically as any perceptible acoustic event with a sudden, rapid onset and fast decay. The impulsive acoustic event can include a gunshot, a drum hit, a balloon pop, a thunder, or a human scream.

In step 504, the audio management system is programmed to determine, for each audio stream of the plurality of audio streams, a subset of samples of the plurality of samples of the audio stream as corresponding to separate potential acoustic events based on spectral analysis of the plurality of audio segments of the audio stream. At least one sample of the subset of samples is deemed to be part of an impulsive acoustic event but not correspond to an onset of the impulsive acoustic event.

In some embodiments, the audio management system is programmed to further generate a debiased audio segment that has no or reduced direct current bias from each audio segment of the audio stream; identify a plurality of initial samples respectively from a plurality of regions of the debiased audio segment defined by sliding a window through the audio segment, where each initial sample has a maximum magnitude within the corresponding region; and selecting a plurality of second samples from the plurality of initial samples that satisfy a first set of criteria characterizing local peaks in a temporal concatenation of the plurality of initial samples. In other embodiments, a length of the window can be ten milliseconds. An amount of sliding can be a half of the length of the window.

In some embodiments, the audio management system is programmed to build a spectrogram for each audio segment of the audio stream; generate a denoised spectrogram that has no or reduced ambient noise from the spectrogram; and selecting a plurality of third samples from the plurality of second samples by skipping second samples that correspond to acoustic events that satisfy a second set of criteria characterizing non-impulsive acoustic events. In other embodiments, the second set of criteria include lacking a sudden appearance of high-energy spectral content, lacking a change in spectral magnitude at both low and high frequencies, or having spectral energy that is neither uniform nor is gradually decreasing with increasing frequencies above frequencies found in ambient noise.

In step 506, the audio management system is programmed to select a list of time points within the common period of time covered by the plurality of subsets of samples based on spectral analysis of the plurality of audio segments of each of the plurality of audio streams. The samples from the plurality of channels for each time point of the list of time points satisfy one or more consistency criteria.

In some embodiments, the audio management system is programmed to, in the selecting, determine a threshold number on identified event occurrences across the plurality of channels from the plurality of subsets of samples and calculating a maximum cumulative spectral magnitude for each audio segment of each of the plurality of audio streams. The one or more consistency criteria can include, for a time point within the common period of time, the threshold number is met across the plurality of channels, or a certain percentage of the maximum cumulative spectral magnitude is met for the plurality of channels. In other embodiments, the threshold number can be a maximum number of channels for which a sample of the plurality of subsets of samples exists for any time point covered by the plurality of subsets of samples. The certain percentage can be 10%.

In step 508, the audio management system is programmed to identify a plurality of candidate time points as candidate onsets of impulsive acoustic events from the list of time points. A size of the plurality of candidate time points is smaller than a size the list of time points.

In some embodiments, the audio management system is programmed to, in the identifying, estimate one or more samples associated with one or more time points of the list of time points as corresponding to high-energy wind and reducing the list of time points by removing time points associated with the one or more samples.

In some embodiments, the audio management system is programmed to, in the identifying, select the list of time points that are at least a certain amount of time apart, and determining, for each of the selected time points, an earliest time step that has a maximum cumulative spectrum magnitude within a region around the selected time point for any of the plurality of channels. In other embodiments, the certain amount can be forty milliseconds. The certain amount can be a length of the region centered around the selected time point.

In step 510, the audio management system is programmed to transmit information regarding the list of candidate onsets to a client device.

In some embodiments, the audio management system is programmed to identify a plurality of updated onsets of impulsive acoustic events based on the plurality of candidate onsets of impulsive acoustic events. Specifically, the audio management system is configured to for each candidate onset of the plurality of candidate onsets and for each of the plurality of channels, determine a maximum amplitude in the corresponding audio stream within a region around the candidate onset; identify a first time point in the region for which a sample has at least a certain percentage of the maximum amplitude; and locating a final time point prior to the first time point corresponding to a zero crossing in the corresponding audio stream. In other embodiments, the region can have a length of 20 milliseconds. The certain percentage can be 50%.

In some embodiments, the audio management system is programmed to, for each candidate onsets of the plurality of candidate onsets, further determine an aggregate of the final time points over the plurality of channels as a final onset. In other embodiments, the audio management system is programmed to further transmit information regarding the list of final onsets to the client device.

In some embodiments, the audio management system is programmed to align the plurality of audio streams using machine learning techniques, including computing cross-correlation for each pair of audio streams or building multivariate autoregressive models using the plurality of audio streams.

6. Hardware Overview

According to one embodiment, the techniques described herein are implemented by at least one computing device. The techniques may be implemented in whole or in part using a combination of at least one server computer and/or other computing devices that are coupled using a network, such as a packet data network. The computing devices may be hard-wired to perform the techniques, or may include digital electronic devices such as at least one application-specific integrated circuit (ASIC) or field programmable gate array (FPGA) that is persistently programmed to perform the techniques, or may include at least one general purpose hardware processor programmed to perform the techniques pursuant to program instructions in firmware, memory, other storage, or a combination. Such computing devices may also combine custom hard-wired logic, ASICs, or FPGAs with custom programming to accomplish the described techniques. The computing devices may be server computers, workstations, personal computers, portable computer systems, handheld devices, mobile computing devices, wearable devices, body mounted or implantable devices, smartphones, smart appliances, internetworking devices, autonomous or semi-autonomous devices such as robots or unmanned ground or aerial vehicles, any other electronic device that incorporates hard-wired and/or program logic to implement the described techniques, one or more virtual computing machines or instances in a data center, and/or a network of server computers and/or personal computers.

Figure 6:
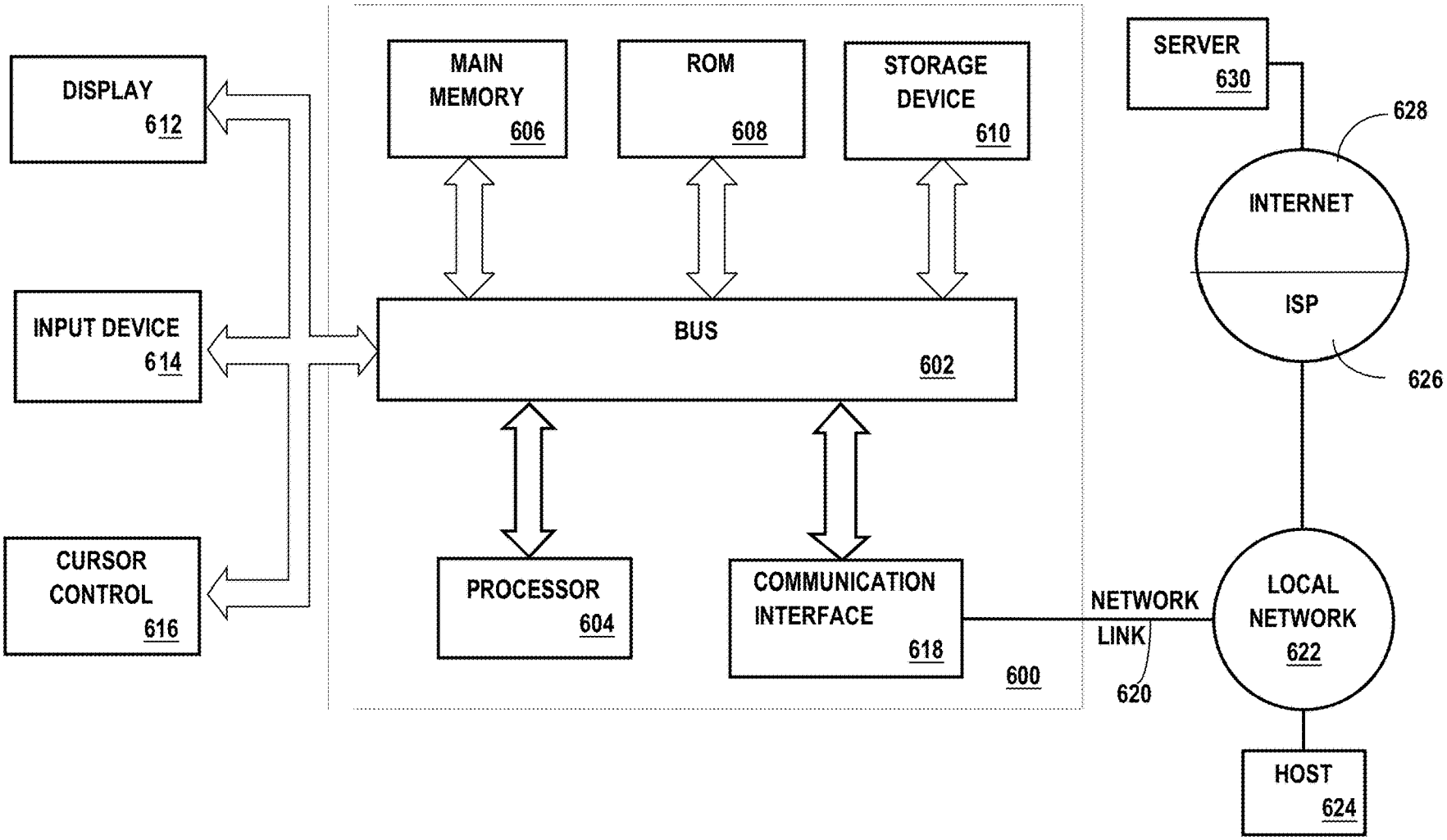
FIG. 6 is a block diagram that illustrates a computer system upon which an embodiment of the invention may be implemented.

FIG. 600 is a block diagram that illustrates an example computer system with which an embodiment may be implemented. In the example of FIG. 6, a computer system 600 and instructions for implementing the disclosed technologies in hardware, software, or a combination of hardware and software, are represented schematically, for example as boxes and circles, at the same level of detail that is commonly used by persons of ordinary skill in the art to which this disclosure pertains for communicating about computer architecture and computer systems implementations.

Computer system 600 includes an input/output (I/O) subsystem 602 which may include a bus and/or other communication mechanism(s) for communicating information and/or instructions between the components of the computer system 600 over electronic signal paths. The I/O subsystem 602 may include an I/O controller, a memory controller and at least one I/O port. The electronic signal paths are represented schematically in the drawings, for example as lines, unidirectional arrows, or bidirectional arrows.

At least one hardware processor 604 is coupled to I/O subsystem 602 for processing information and instructions. Hardware processor 604 may include, for example, a general-purpose microprocessor or microcontroller and/or a special-purpose microprocessor such as an embedded system or a graphics processing unit (GPU) or a digital signal processor or ARM processor. Processor 604 may comprise an integrated arithmetic logic unit (ALU) or may be coupled to a separate ALU.

Computer system 600 includes one or more units of memory 606, such as a main memory, which is coupled to I/O subsystem 602 for electronically digitally storing data and instructions to be executed by processor 604. Memory 606 may include volatile memory such as various forms of random-access memory (RAM) or other dynamic storage device. Memory 606 also may be used for storing temporary variables or other intermediate information during execution of instructions to be executed by processor 604. Such instructions, when stored in non-transitory computer-readable storage media accessible to processor 604, can render computer system 600 into a special-purpose machine that is customized to perform the operations specified in the instructions.

Computer system 600 further includes non-volatile memory such as read only memory (ROM) 608 or other static storage device coupled to I/O subsystem 602 for storing information and instructions for processor 604. The ROM 608 may include various forms of programmable ROM (PROM) such as erasable PROM (EPROM) or electrically erasable PROM (EEPROM). A unit of persistent storage 610 may include various forms of non-volatile RAM (NVRAM), such as FLASH memory, or solid-state storage, magnetic disk or optical disk such as CD-ROM or DVD-ROM, and may be coupled to I/O subsystem 602 for storing information and instructions. Storage 610 is an example of a non-transitory computer-readable medium that may be used to store instructions and data which when executed by the processor 604 cause performing computer-implemented methods to execute the techniques herein.

The instructions in memory 606, ROM 608 or storage 610 may comprise one or more sets of instructions that are organized as modules, methods, objects, functions, routines, or calls. The instructions may be organized as one or more computer programs, operating system services, or application programs including mobile apps. The instructions may comprise an operating system and/or system software; one or more libraries to support multimedia, programming or other functions; data protocol instructions or stacks to implement TCP/IP, HTTP or other communication protocols; file processing instructions to interpret and render files coded using HTML, XML, JPEG, MPEG or PNG; user interface instructions to render or interpret commands for a graphical user interface (GUI), command-line interface or text user interface; application software such as an office suite, internet access applications, design and manufacturing applications, graphics applications, audio applications, software engineering applications, educational applications, games or miscellaneous applications. The instructions may implement a web server, web application server or web client. The instructions may be organized as a presentation layer, application layer and data storage layer such as a relational database system using structured query language (SQL) or NoSQL, an object store, a graph database, a flat file system or other data storage.

Computer system 600 may be coupled via I/O subsystem 602 to at least one output device 612. In one embodiment, output device 612 is a digital computer display. Examples of a display that may be used in various embodiments include a touch screen display or a light-emitting diode (LED) display or a liquid crystal display (LCD) or an e-paper display. Computer system 600 may include other type(s) of output devices 612, alternatively or in addition to a display device. Examples of other output devices 612 include printers, ticket printers, plotters, projectors, sound cards or video cards, speakers, buzzers or piezoelectric devices or other audible devices, lamps or LED or LCD indicators, haptic devices, actuators or servos.

At least one input device 614 is coupled to I/O subsystem 602 for communicating signals, data, command selections or gestures to processor 604. Examples of input devices 614 include touch screens, microphones, still and video digital cameras, alphanumeric and other keys, keypads, keyboards, graphics tablets, image scanners, joysticks, clocks, switches, buttons, dials, slides, and/or various types of sensors such as force sensors, motion sensors, heat sensors, accelerometers, gyroscopes, and inertial measurement unit (IMU) sensors and/or various types of transceivers such as wireless, such as cellular or Wi-Fi, radio frequency (RF) or infrared (IR) transceivers and Global Positioning System (GPS) transceivers.

Another type of input device is a control device 616, which may perform cursor control or other automated control functions such as navigation in a graphical interface on a display screen, alternatively or in addition to input functions. Control device 616 may be a touchpad, a mouse, a trackball, or cursor direction keys for communicating direction information and command selections to processor 604 and for controlling cursor movement on display 612. The input device may have at least two degrees of freedom in two axes, a first axis (e.g., x) and a second axis (e.g., y), that allows the device to specify positions in a plane. Another type of input device is a wired, wireless, or optical control device such as a joystick, wand, console, steering wheel, pedal, gearshift mechanism or other type of control device. An input device 614 may include a combination of multiple different input devices, such as a video camera and a depth sensor.

In another embodiment, computer system 600 may comprise an internet of things (IoT) device in which one or more of the output device 612, input device 614, and control device 616 are omitted. Or, in such an embodiment, the input device 614 may comprise one or more cameras, motion detectors, thermometers, microphones, seismic detectors, other sensors or detectors, measurement devices or encoders and the output device 612 may comprise a special-purpose display such as a single-line LED or LCD display, one or more indicators, a display panel, a meter, a valve, a solenoid, an actuator or a servo.

When computer system 600 is a mobile computing device, input device 614 may comprise a global positioning system (GPS) receiver coupled to a GPS module that is capable of triangulating to a plurality of GPS satellites, determining and generating geo-location or position data such as latitude-longitude values for a geophysical location of the computer system 600. Output device 612 may include hardware, software, firmware and interfaces for generating position reporting packets, notifications, pulse or heartbeat signals, or other recurring data transmissions that specify a position of the computer system 600, alone or in combination with other application-specific data, directed toward host 624 or server 630.

Computer system 600 may implement the techniques described herein using customized hard-wired logic, at least one ASIC or FPGA, firmware and/or program instructions or logic which when loaded and used or executed in combination with the computer system causes or programs the computer system to operate as a special-purpose machine. According to one embodiment, the techniques herein are performed by computer system 600 in response to processor 604 executing at least one sequence of at least one instruction contained in main memory 606. Such instructions may be read into main memory 606 from another storage medium, such as storage 610. Execution of the sequences of instructions contained in main memory 606 causes processor 604 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage 610. Volatile media includes dynamic memory, such as memory 606. Common forms of storage media include, for example, a hard disk, solid state drive, flash drive, magnetic data storage medium, any optical or physical data storage medium, memory chip, or the like.

Storage media is distinct from but may be used in conjunction with transmission media. Transmission media participates in transferring information between storage media. For example, transmission media includes coaxial cables, copper wire and fiber optics, including the wires that comprise a bus of I/O subsystem 602. Transmission media can also take the form of acoustic or light waves, such as those generated during radio-wave and infra-red data communications.

Various forms of media may be involved in carrying at least one sequence of at least one instruction to processor 604 for execution. For example, the instructions may initially be carried on a magnetic disk or solid-state drive of a remote computer. The remote computer can load the instructions into its dynamic memory and send the instructions over a communication link such as a fiber optic or coaxial cable or telephone line using a modem. A modem or router local to computer system 600 can receive the data on the communication link and convert the data to be read by computer system 600. For instance, a receiver such as a radio frequency antenna or an infrared detector can receive the data carried in a wireless or optical signal and appropriate circuitry can provide the data to I/O subsystem 602 such as place the data on a bus. I/O subsystem 602 carries the data to memory 606, from which processor 604 retrieves and executes the instructions. The instructions received by memory 606 may optionally be stored on storage 610 either before or after execution by processor 604.

Computer system 600 also includes a communication interface 618 coupled to bus 602. Communication interface 618 provides a two-way data communication coupling to network link(s) 620 that are directly or indirectly connected to at least one communication networks, such as a network 622 or a public or private cloud on the Internet. For example, communication interface 618 may be an Ethernet networking interface, integrated-services digital network (ISDN) card, cable modem, satellite modem, or a modem to provide a data communication connection to a corresponding type of communications line, for example an Ethernet cable or a metal cable of any kind or a fiber-optic line or a telephone line. Network 622 broadly represents a local area network (LAN), wide-area network (WAN), campus network, internetwork or any combination thereof. Communication interface 618 may comprise a LAN card to provide a data communication connection to a compatible LAN, or a cellular radiotelephone interface that is wired to send or receive cellular data according to cellular radiotelephone wireless networking standards, or a satellite radio interface that is wired to send or receive digital data according to satellite wireless networking standards. In any such implementation, communication interface 618 sends and receives electrical, electromagnetic or optical signals over signal paths that carry digital data streams representing various types of information.

Network link 620 typically provides electrical, electromagnetic, or optical data communication directly or through at least one network to other data devices, using, for example, satellite, cellular, Wi-Fi, or BLUETOOTH technology. For example, network link 620 may provide a connection through a network 622 to a host computer 624.

Furthermore, network link 620 may provide a connection through network 622 or to other computing devices via internetworking devices and/or computers that are operated by an Internet Service Provider (ISP) 626. ISP 626 provides data communication services through a world-wide packet data communication network represented as internet 628. A server computer 630 may be coupled to internet 628. Server 630 broadly represents any computer, data center, virtual machine or virtual computing instance with or without a hypervisor, or computer executing a containerized program system such as DOCKER or KUBERNETES. Server 630 may represent an electronic digital service that is implemented using more than one computer or instance and that is accessed and used by transmitting web services requests, uniform resource locator (URL) strings with parameters in HTTP payloads, API calls, app services calls, or other service calls. Computer system 600 and server 630 may form elements of a distributed computing system that includes other computers, a processing cluster, server farm or other organization of computers that cooperate to perform tasks or execute applications or services. Server 630 may comprise one or more sets of instructions that are organized as modules, methods, objects, functions, routines, or calls. The instructions may be organized as one or more computer programs, operating system services, or application programs including mobile apps. The instructions may comprise an operating system and/or system software; one or more libraries to support multimedia, programming or other functions; data protocol instructions or stacks to implement TCP/IP, HTTP or other communication protocols; file format processing instructions to interpret or render files coded using HTML, XML, JPEG, MPEG or PNG; user interface instructions to render or interpret commands for a graphical user interface (GUI), command-line interface or text user interface; application software such as an office suite, internet access applications, design and manufacturing applications, graphics applications, audio applications, software engineering applications, educational applications, games or miscellaneous applications. Server 630 may comprise a web application server that hosts a presentation layer, application layer and data storage layer such as a relational database system using structured query language (SQL) or NoSQL, an object store, a graph database, a flat file system or other data storage.

Computer system 600 can send messages and receive data and instructions, including program code, through the network(s), network link 620 and communication interface 618. In the Internet example, a server 630 might transmit a requested code for an application program through Internet 628, ISP 626, local network 622 and communication interface 618. The received code may be executed by processor 604 as it is received, and/or stored in storage 610, or other non-volatile storage for later execution.

The execution of instructions as described in this section may implement a process in the form of an instance of a computer program that is being executed, and consisting of program code and its current activity. Depending on the operating system (OS), a process may be made up of multiple threads of execution that execute instructions concurrently. In this context, a computer program is a passive collection of instructions, while a process may be the actual execution of those instructions. Several processes may be associated with the same program; for example, opening up several instances of the same program often means more than one process is being executed. Multitasking may be implemented to allow multiple processes to share processor 604. While each processor 604 or core of the processor executes a single task at a time, computer system 600 may be programmed to implement multitasking to allow each processor to switch between tasks that are being executed without having to wait for each task to finish. In an embodiment, switches may be performed when tasks perform input/output operations, when a task indicates that it can be switched, or on hardware interrupts. Time-sharing may be implemented to allow fast response for interactive user applications by rapidly performing context switches to provide the appearance of concurrent execution of multiple processes simultaneously. In an embodiment, for security and reliability, an operating system may prevent direct communication between independent processes, providing strictly mediated and controlled inter-process communication functionality.

7. Extensions and Alternatives

In the foregoing specification, embodiments of the disclosure have been described with reference to numerous specific details that may vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction.

What is claimed is:

1. A computer-implemented method of determining time-based onsets of impulsive acoustic events, comprising:

receiving in real time, by a processor, a plurality of audio streams generated by a plurality of sensors located on a physical device, the plurality of sensors respectively corresponding to a plurality of channels;

each audio stream of the plurality of audio streams comprising a plurality of samples taken over a common period of time in which an impulsive acoustic event occurred, each audio stream of the plurality of audio streams being divided into a plurality of audio segments;

determining, for each audio stream of the plurality of audio streams, a subset of samples of the plurality of samples of the audio stream as corresponding to separate potential acoustic events based on spectral analysis of the plurality of audio segments of the audio stream, at least one sample of the subset of samples deemed to be part of an impulsive acoustic event but not correspond to an onset of the impulsive acoustic event;

selecting a list of time points within the common period of time covered by the plurality of subsets of samples based on spectral analysis of the plurality of audio segments of each of the plurality of audio streams, the samples from the plurality of channels for each time point of the list of time points satisfying one or more consistency criteria;

identifying a plurality of candidate time points as candidate onsets of impulsive acoustic events from the list of time points, a size of the plurality of candidate time points being smaller than a size the list of time points;

transmitting information regarding the list of candidate onsets to a client device.

2. The computer-implemented method of claim 1, each of the plurality of audio streams being sampled at 48 kHz, each of the plurality of audio segments being one second long.

3. The computer-implemented method of claim 1, the determining comprising:

generating a debiased audio segment that has no or reduced direct current bias from each audio segment of the audio stream;

identifying a plurality of initial samples respectively from a plurality of regions of the debiased audio segment defined by sliding a window through the audio segment, each initial sample having a maximum magnitude within the corresponding region;

selecting a plurality of second samples from the plurality of initial samples that satisfy a first set of criteria characterizing local peaks in a temporal concatenation of the plurality of initial samples.

4. The computer-implemented method of claim 3, a length of the window being ten milliseconds, an amount of sliding being half of the length of the window.

5. The computer-implemented method of claim 3, the determining further comprising:

building a spectrogram for each audio segment of the audio stream;

generating a denoised spectrogram that has no or reduced ambient noise from the spectrogram;

selecting a plurality of third samples from the plurality of second samples by skipping second samples that correspond to acoustic events that satisfy a second set of criteria characterizing non-impulsive acoustic events.

6. The computer-implemented method of claim 5, the second set of criteria including lacking a sudden appearance of high-energy spectral content, lacking a change in spectral magnitude at both low and high frequencies, or having spectral energy that is neither uniform nor is gradually decreasing with increasing frequencies above frequencies found in ambient noise.

7. The computer-implemented method of claim 1, the selecting comprising:

determining a threshold number on identified event occurrences across the plurality of channels from the plurality of subsets of samples;

calculating a maximum cumulative spectral magnitude for each audio segment of each of the plurality of audio streams;

the one or more consistency criteria including, for a time point within the common period of time, the threshold number is met across the plurality of channels or a certain percentage of the maximum cumulative spectral magnitude is met for the plurality of channels.

8. The computer-implemented method of claim 7, the threshold number being a maximum number of channels for which a sample of the plurality of subsets of samples exists for any time point covered by the plurality of subsets of samples, the certain percentage being 10%.

9. The computer-implemented method of claim 1, the identifying comprising:

estimating one or more samples associated with one or more time points of the list of time points as corresponding to high-energy wind;

reducing the list of time points by removing time points associated with the one or more samples.

10. The computer-implemented method of claim 1, the identifying comprising:

selecting the list of time points that are at least a certain amount of time apart;

determining, for each of the selected time points, an earliest time step that has a maximum cumulative spectrum magnitude within a region around the selected time point for any of the plurality of channels.

11. The computer-implemented method of claim 10, the certain amount being forty milliseconds, the certain amount being a length of the region centered around the selected time point.

12. The computer-implemented method of claim 1, further comprising identifying a plurality of updated onsets of impulsive acoustic events based on the plurality of candidate onsets of impulsive acoustic events, comprising, for each candidate onset of the plurality of candidate onsets and for each of the plurality of channels:

determining a maximum amplitude in the corresponding audio stream within a region around the candidate onset;

identifying a first time point in the region for which a sample has at least a certain percentage of the maximum amplitude;

locating a final time point prior to the first time point corresponding to a zero crossing in the corresponding audio stream.

13. The computer-implemented method of claim 12, the region having a length of 20 milliseconds, the certain percentage being 50%.

14. The computer-implemented method of claim 12, further comprising:

for each candidate onsets of the plurality of candidate onsets, determining an aggregate of the final time points over the plurality of channels as a final onset;

transmitting further information regarding the list of final onsets to the client device.

15. The computer-implemented method of claim 1, the impulsive acoustic event being defined empirically as any perceptible acoustic event with a sudden, rapid onset and fast decay, the impulsive acoustic event including a gunshot, a drum hit, a balloon pop, a thunder, or a human scream.

16. The computer-implemented method of claim 1, further comprising aligning the plurality of audio streams using machine learning techniques, including computing cross-correlation for each pair of audio streams or building multivariate autoregressive models using the plurality of audio streams.

17. One or more non-transitory computer-readable media storing one or more sequences of instructions which when executed using one or more processors cause the one or more processors to execute a method of determining time-based onsets of impulsive acoustic events, the method comprising:

receiving in real time a plurality of audio streams generated by a plurality of sensors located on a physical device, the plurality of sensors respectively corresponding to a plurality of channels;

each audio stream of the plurality of audio streams comprising a plurality of samples taken over a common period of time in which an impulsive acoustic event occurred, each audio stream of the plurality of audio streams being divided into a plurality of audio segments;

determining, for each audio stream of the plurality of audio streams, a subset of samples of the plurality of samples of the audio stream as corresponding to separate potential acoustic events based on spectral analysis of the plurality of audio segments of the audio stream, at least one sample of the subset of samples deemed to be part of an impulsive acoustic event but not correspond to an onset of the impulsive acoustic event;

selecting a list of time points within the common period of time covered by the plurality of subsets of sample based on spectral analysis of the plurality of audio segments of each of the plurality of audio streams, the samples from the plurality of channels for each time point of the list of time points satisfying one or more consistency criteria;

identifying a plurality of candidate time points as candidate onsets of impulsive acoustic events from the list of time points, a size of the plurality of candidate time points being smaller than a size the list of time points;

transmitting information regarding the list of candidate onsets to a client device.

18. A system for determining time-based onsets of impulsive acoustic events, comprising:

one or more memories;

one or more processors coupled to the one or more memories and configured to perform:

receiving in real time a plurality of audio streams generated by a plurality of sensors located on a physical device, the plurality of sensors respectively corresponding to a plurality of channels;

each audio stream of the plurality of audio streams comprising a plurality of samples taken over a common period of time in which an impulsive acoustic event occurred, each audio stream of the plurality of audio streams being divided into a plurality of audio segments;

determining, for each audio stream of the plurality of audio streams, a subset of samples of the plurality of samples of the audio stream as corresponding to separate potential acoustic events based on spectral analysis of the plurality of audio segments of the audio stream, at least one sample of the subset of samples deemed to be part of an impulsive acoustic event but not correspond to an onset of the impulsive acoustic event;

selecting a list of time points within the common period of time covered by the plurality of subsets of sample based on spectral analysis of the plurality of audio segments of each of the plurality of audio streams, the samples from the plurality of channels for each time point of the list of time points satisfying one or more consistency criteria;

identifying a plurality of candidate time points as candidate onsets of impulsive acoustic events from the list of time points, a size of the plurality of candidate time points being smaller than a size the list of time points;

transmitting information regarding the list of candidate onsets to a client device.

* * * * *